US007337499B2

(12) United States Patent
Zhang et al.

(10) Patent No.: US 7,337,499 B2
(45) Date of Patent: Mar. 4, 2008

(54) KNUCKLE ARM

(75) Inventors: Kuang-Wei Zhang, Dong-Guan (CN); Tai-Xiong Chen, Dong-Guan (CN)

(73) Assignee: Asia Optical Co., Inc., Taichung (TW)

( * ) Notice: Subject to any disclaimer, the term of this patent is extended or adjusted under 35 U.S.C. 154(b) by 214 days.

(21) Appl. No.: 11/173,749

(22) Filed: Jul. 1, 2005

(65) Prior Publication Data

US 2006/0113457 A1 Jun. 1, 2006

(51) Int. Cl.
*E05D 11/06* (2006.01)

(52) U.S. Cl. ..... 16/357; 16/286

(58) Field of Classification Search ..... 16/284, 16/277, 286, 270, 298, 335, 384, 382, 357; 248/284.1, 276.1, 286.11, 287.1; 399/361, 399/363, 380, 379; 355/75, 76
See application file for complete search history.

(56) References Cited

U.S. PATENT DOCUMENTS 3,001,225 A * 9/1961 Squire ..... 16/287
3,351,975 A * 11/1967 Goto ..... 16/288
3,906,587 A * 9/1975 Little ..... 16/289
4,069,547 A * 1/1978 Guionie et al. ..... 16/323
4,236,272 A * 12/1980 Gronbach et al. ..... 16/288
4,771,507 A * 9/1988 Draplin et al. ..... 16/297
5,356,095 A * 10/1994 Aker ..... 244/172.6
5,621,501 A * 4/1997 Matsuo et al. ..... 355/75
6,100,963 A * 8/2000 Hosaka ..... 355/75
6,456,365 B1 9/2002 Hosaka et al.
6,530,122 B1 * 3/2003 Kondou et al. ..... 16/335
6,574,835 B2 * 6/2003 Melhuish ..... 16/282
6,593,999 B1 * 7/2003 Hosaka ..... 355/75
6,629,336 B2 * 10/2003 Hosaka et al. ..... 16/327
6,928,698 B2 * 8/2005 Chen et al. ..... 16/277
7,012,675 B1 * 3/2006 Zhang et al. ..... 355/75

* cited by examiner

*Primary Examiner*—Chuck Y. Mah
(74) *Attorney, Agent, or Firm*—Christie, Parker & Hale, LLP

(57) ABSTRACT

A knuckle arm interconnects a machine body and a top cover of a machine, and includes a base fixed on the machine body, and a pivot seat connected pivotally to the base and attached to the top cover. A biasing unit is disposed between the base and the pivot seat so as to bias the top cover to pivot upwardly. A friction assembly imparts a resistance to pivoting of the top cover so as to maintain the top cover at any position.

6 Claims, 9 Drawing Sheets

KNUCKLE ARM

CROSS-REFERENCE TO RELATED APPLICATION

This application claims priority of Taiwanese Application No. 093135981, filed on Nov. 23, 2004.

BACKGROUND OF THE INVENTION

1. Field of the Invention

This invention relates to a part of an office machine, and more particularly to a knuckle arm that interconnects a machine body and a top cover of an office machine.

2. Description of the Related Art

Two knuckle arms are typically disposed between a top cover and a machine body of an office machine, such as a copier or scanner, for use in the opening and closing of the top cover relative to the machine body. Referring to FIG. 1, a conventional knuckle arm 10, which is disclosed in U.S. Pat. No. 6,456,365, is shown to include a mounting seat 11 fixed on a machine body 21 of an office machine 20, a connecting seat 12 disposed pivotally on the mounting seat 11, a bottom cam sliding seat 13 disposed slidably within the connecting seat 12, a top cam sliding seat 14 disposed slidably within the connecting seat 12 and located above the bottom cam sliding seat 13, a compression spring 15 disposed between the bottom and top cam sliding seats 13, 14, a lifting seat 16 disposed pivotally on the connecting seat 12 and connected fixedly to a top cover 22 of the office machine 20, a bottom pivot rod 17 extending through the mounting seat 11 and the connecting seat 12 and kept in contact with a cam surface 131 of the bottom cam sliding seat 13, and a top pivot rod 18 extending through the connecting seat 12 and kept in contact with a cam surface 141 of the top cam sliding seat 14.

As such, a force can be applied to the top cover 22 so as to open and close the top cover 22 relative to the machine body 21. Although the knuckle arm 10 can achieve its intended purposes, in actual use, it suffers from the following disadvantages:

(1) The knuckle arm 10 consists of numerous parts. This results in high manufacturing costs.

(2) The cam surfaces 131, 141 of the bottom and top cam sliding seats 13, 14 must be made highly precise. Thus, the manufacturing costs of the knuckle arm 10 are further increased.

SUMMARY OF THE INVENTION

An object of this invention is to provide a knuckle arm that has a simple structure so as to reduce manufacturing costs.

Accordingly, a knuckle arm of this invention interconnects a machine body and a top cover of a machine, and includes a base disposed fixedly on the machine body, a pivot seat connected pivotally to the base and attached to the top cover, and a first pivot rod extending through the pivot seat and the base. The knuckle arm further includes a biasing unit and a friction assembly, which are disposed between the base and the pivot seat.

The base includes a mounting plate disposed fixedly on the machine body, and two pivot plates extending respectively from two opposite sides of the mounting plate. Each of the pivot plates is formed with a pivot hole, a curved guide slot and a through hole.

The pivot seat includes two wing plates located respectively to two opposite sides of an assembly of the pivot plates of the base, and a connecting plate interconnecting fixedly the wing plates of the pivot seat. Each of the wing plates of the pivot seat is formed with a pivot hole and a through hole.

The first pivot rod extends through the pivot holes in the pivot plates of the base and in the wing plates of the pivot seat so as to allow for pivoting of the pivot seat about the first pivot rod.

The biasing unit includes a first supporting rod extending through the through holes in the pivot plates of the base, a second supporting rod extending through the wing plates of the pivot seat, and a tension spring interconnecting the first and second supporting rods so as to bias the pivot seat and, therefore, the top cover to pivot upwardly.

The friction assembly includes a frictional block connected fixedly to the base and having a frictional surface, and a frictional rod extending through the guide slots in the pivot plates of the base and the through holes in the wing plates of the pivot seat. The frictional rod is movable to press against the frictional surface of the frictional block so as to impart a resistance to pivoting of the pivot seat and the top cover. This maintains the top cover at any position. As such, the structure of the knuckle arm is simple, and therefore can be made at a low cost.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 2:
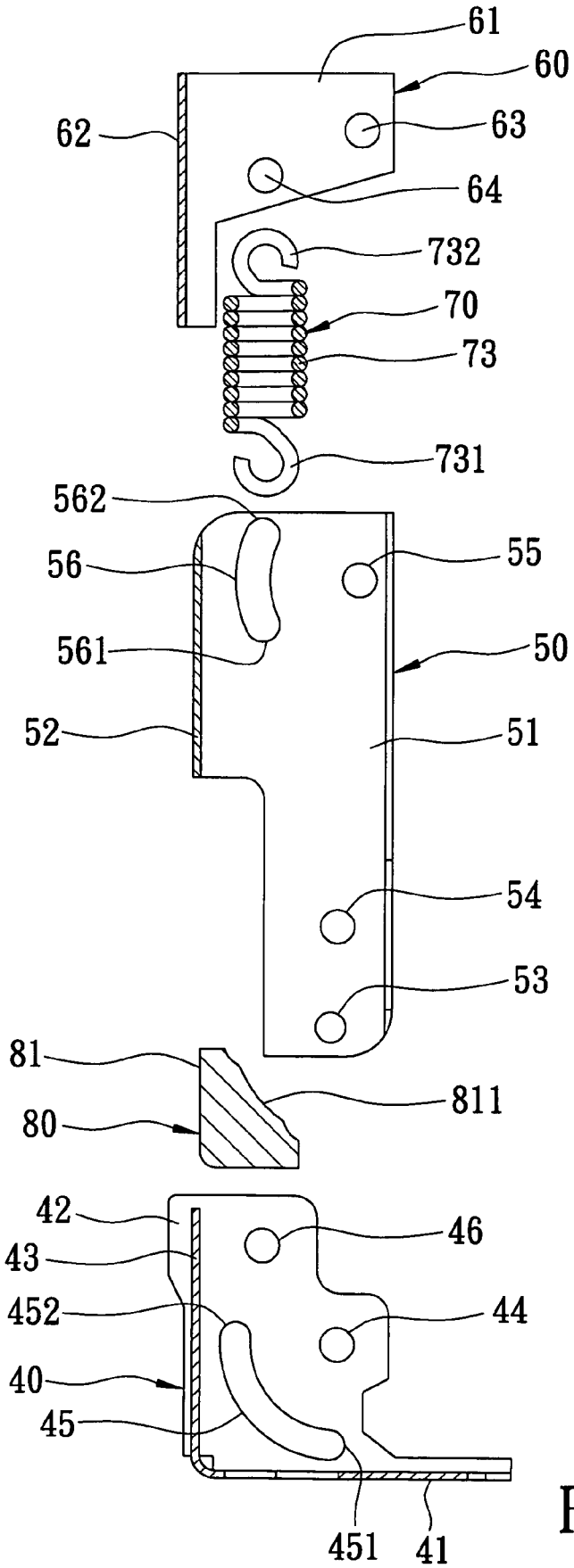
FIG. 2 is an exploded sectional view of the preferred embodiment of a knuckle arm according to this invention.
Figure 9:
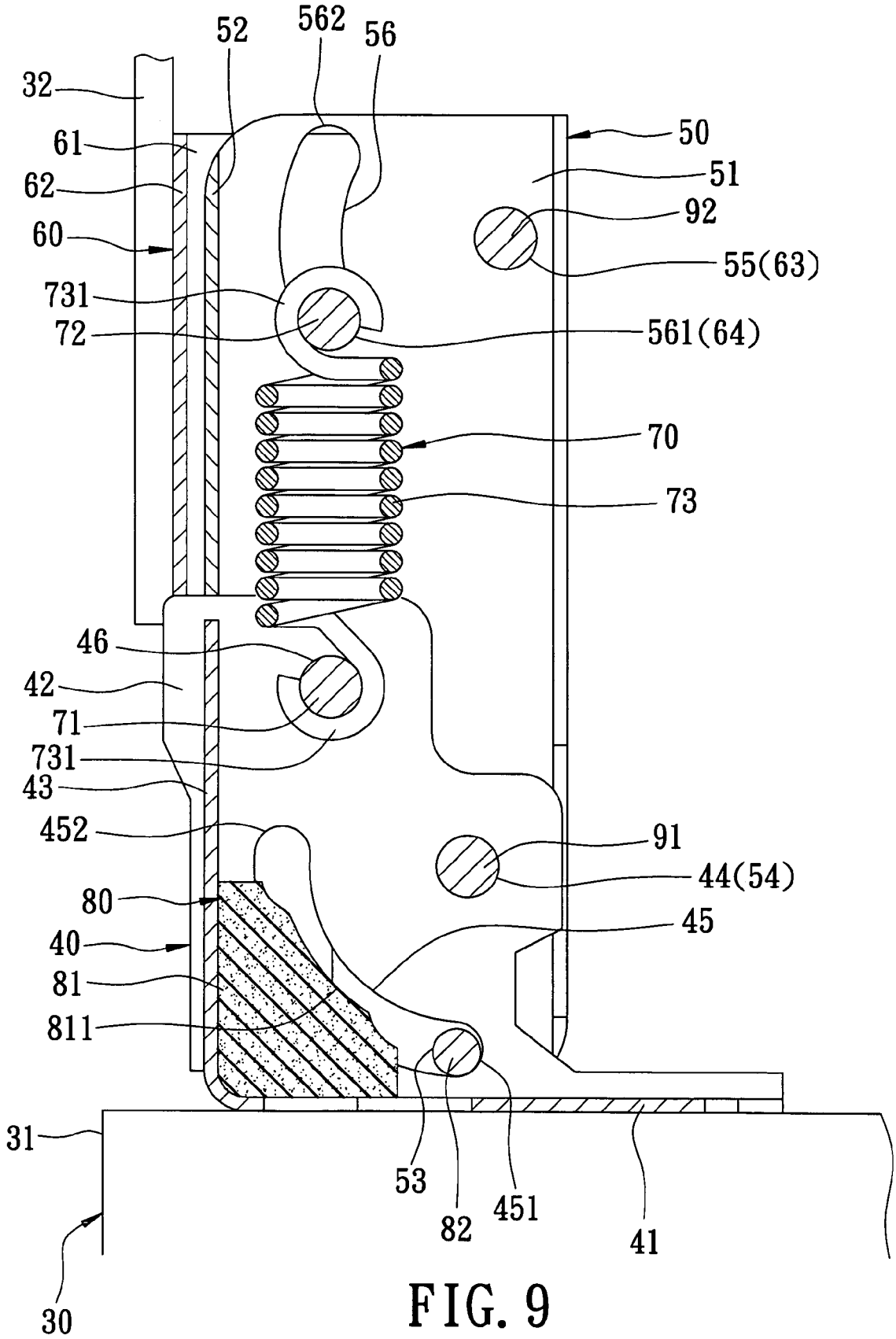
FIG. 9 is a sectional side view of the preferred embodiment, illustrating how the top cover of the office machine is opened to an angle of about 90 degrees.

Referring to FIGS. 2 and 9, the preferred embodiment of a knuckle arm according to this invention interconnects a machine body 31 and a top cover 32 of an office machine 30, and is constructed so as to allow for the opening and closing of the top cover 32 relative to the machine body 31. The office machine may be a copier, scanner, etc.

The knuckle arm includes a base 40, a pivot seat 50 connected rotatably to the base 40 by a first pivot rod 91, a connecting seat 60 connected rotatably to the pivot seat 50 by a second pivot rod 92, a biasing unit 70 disposed between the base 40 and the pivot seat 50, and a friction assembly 80 disposed between the base 40 and the pivot seat 50.

Figure 3:
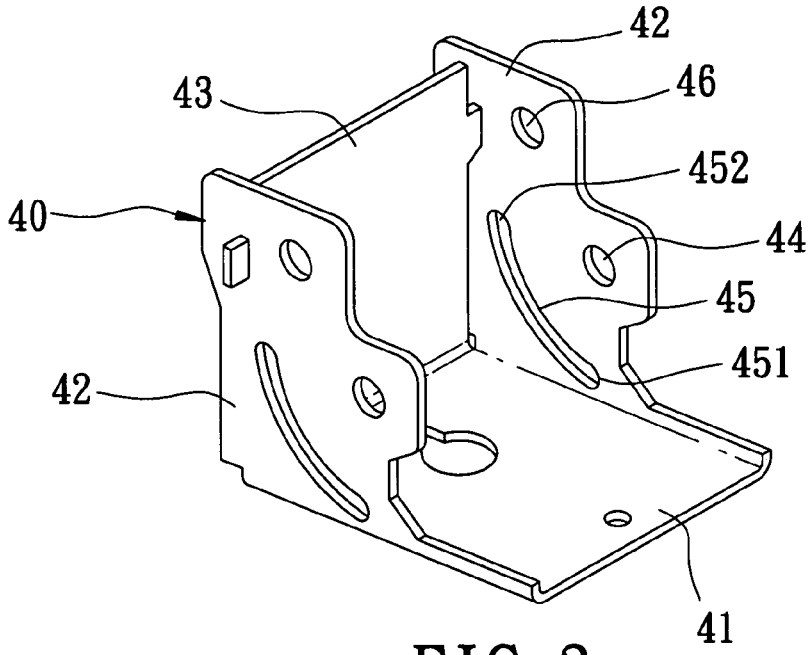
FIG. 3 is a perspective view of a base of the preferred embodiment.
Figure 7:
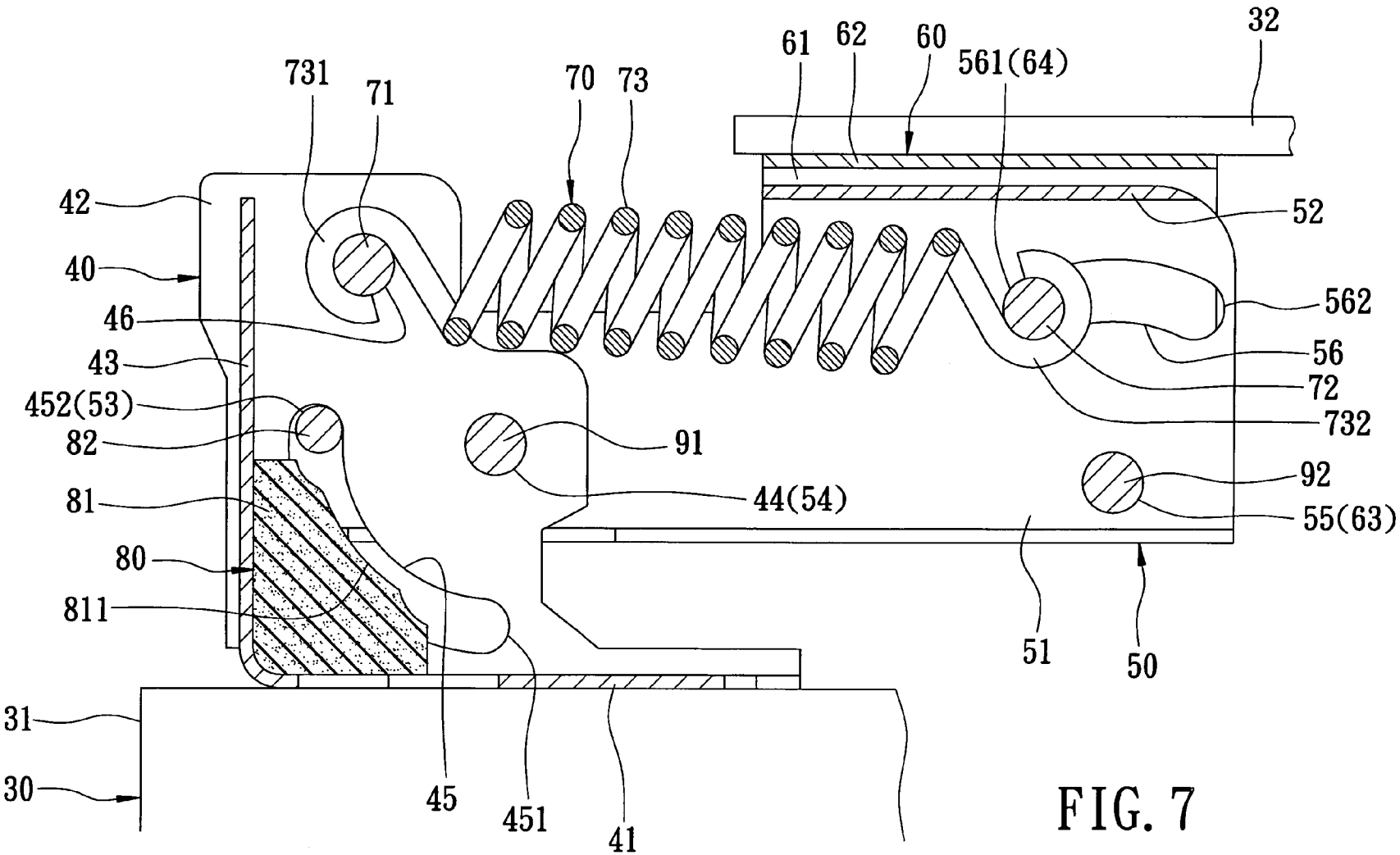
FIG. 7 is a sectional side view of the preferred embodiment, illustrating how a top cover of an office machine is closed.

Referring to FIGS. 2 and 3, the base 40 includes a mounting plate 41 disposed fixedly on the machine body 31, as shown in FIG. 7, two pivot plates 42 extending respectively, integrally, and perpendicularly from two opposite sides of the mounting plate 41, and a connecting plate 43 extending from the mounting plate 41 and connected fixedly to the pivot plates 42 so as to structurely strengthen the base 40. Each of the pivot plates 42 is formed with a pivot hole 44, a curved guide slot 45 and a through hole 46. Each of the curved guide slots 45 has a first slot end 451 proximate to the mounting plate 41, and a second slot end 452 distal from the mounting plate 41.

Figure 4:
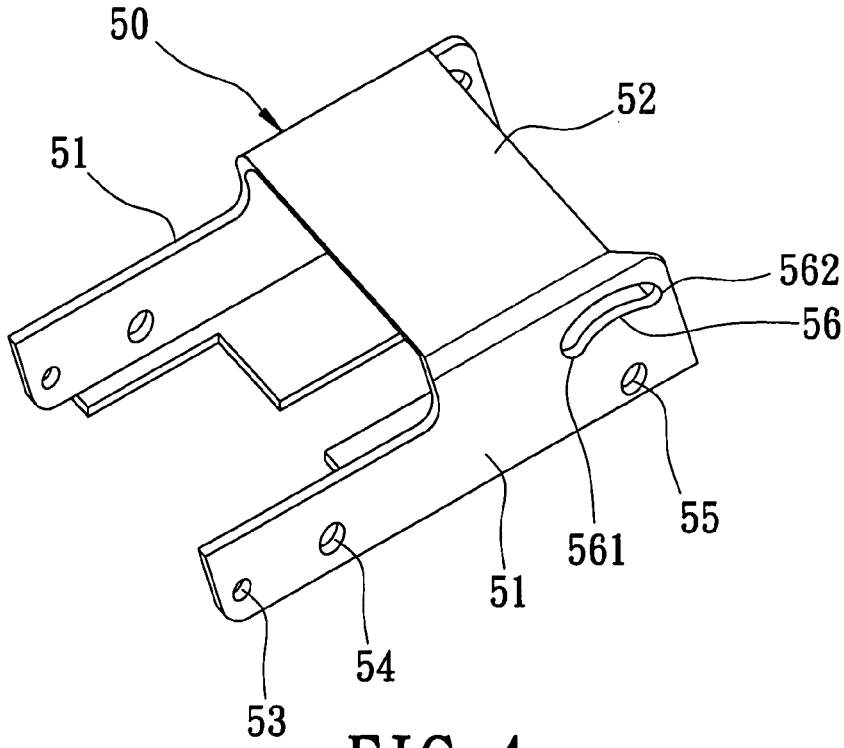
FIG. 4 is a perspective view of a pivot seat of the preferred embodiment.

Referring to FIGS. 2 and 4, the pivot seat 50 includes two wing plates 51 located respectively to two opposite sides of an assembly of the pivot plates 42 of the base 40, and a connecting plate 52 interconnecting fixedly the wing plates 51. Each of the wing plates 51 of the pivot seat 50 is formed with a through hole 53, a first pivot hole 54, a second pivot hole 55 and a curved slide slot 56. Each of the curved slide slots 56 has a first slot end 561 proximate to the base 40, and a second slot end 562 distal from the base 40.

Figure 5:
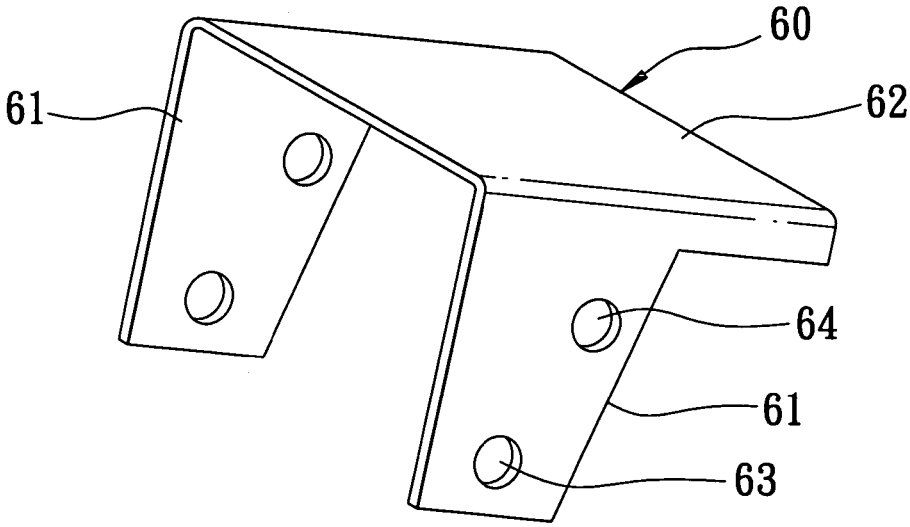
FIG. 5 is a perspective view of a connecting seat of the preferred embodiment.

Referring to FIGS. 2 and 5, the connecting seat 60 includes two wing plates 61 located respectively to two opposite sides of an assembly of the wing plates 51 of the pivot seat 50, and a connecting plate 62 interconnecting fixedly the wing plates 61 of the connecting seat 60 and connected fixedly to the cover plate 32, as shown in FIG. 7. Each of the wing plates 61 of the connecting seat 60 is formed with a pivot hole 63 and a through hole 64.

Referring to FIGS. 2 and 7, the biasing unit 70 includes a first supporting rod 71 extending through the through holes 46 in the pivot plates 42 of the base 40, a second supporting rod 72 extending through the through holes 64 in the wing plates 61 of the connecting seat 60 and the curved slide slots 56 in the wing plates 51 of the pivot seat 50, and a resilient member 73 disposed between the first and second supporting rods 71, 72. The resilient member 73 is configured as a coiled tension spring, and has a first end hook 731 engaging the first supporting rod 71, and a second end hook 732 engaging the second supporting rod 72.

Figure 8:
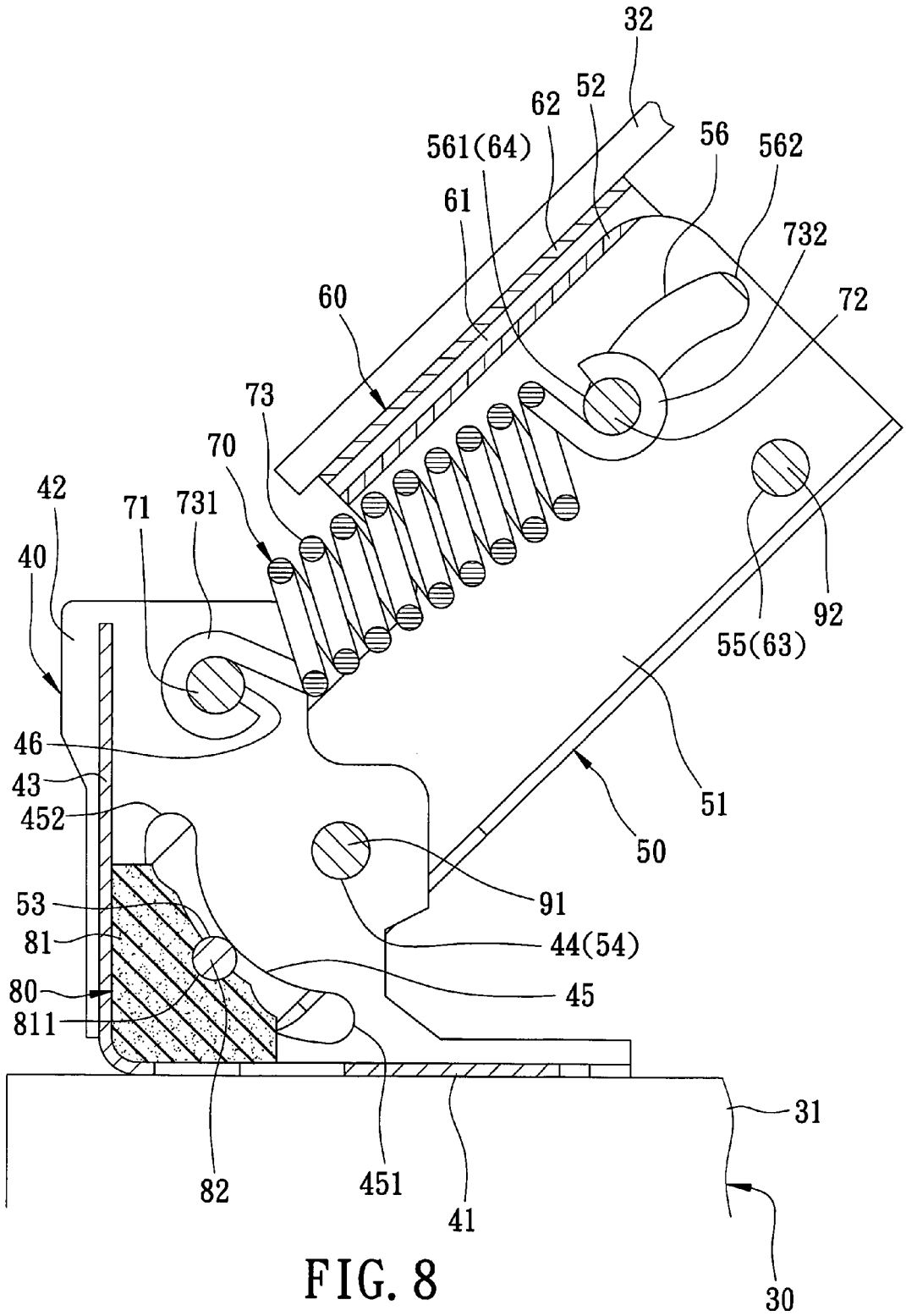
FIG. 8 is a sectional side view of the preferred embodiment, illustrating how the top cover of the office machine is opened to an angle ranging between 30 and 90 degrees.

FIG. 7 illustrates the closed position of the top cover 32. FIG. 8 illustrates a half-opened position of the top cover 32, in which the top cover 32 is opened to an angle ranging between 30 and 90 degrees. FIG. 9 illustrates the completely open position (i.e., 90° open position) of the top cover 32. When the opening angle of the top cover 32 with respect to the machine body 31 is smaller than 90 degrees, the resilient member 73 is stretched, as shown in FIGS. 7 and 8.

Figure 6:
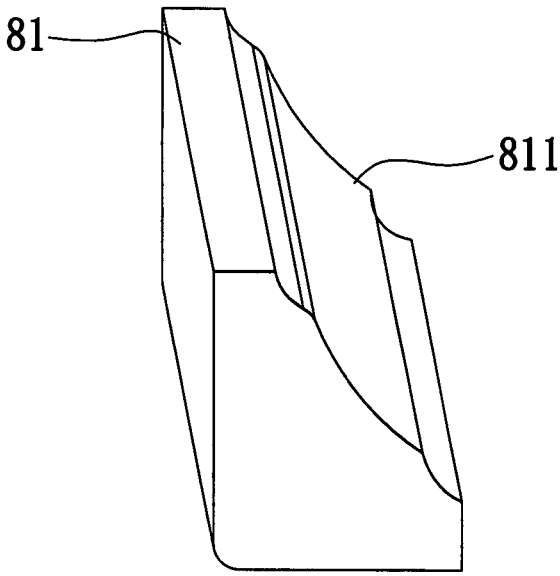
FIG. 6 is a perspective view of a frictional block of the preferred embodiment.

Referring to FIGS. 2, 6 and 7, the friction assembly 80 imparts a resistance to pivoting of the pivot seat 50, ultimately gaining an ability to maintain the top cover 32 at any position. The friction assembly 80 includes a frictional block 81 connected fixedly to the mounting plate 41 of the base 40 and having a frictional surface 811, and a frictional rod 82 extending through the through holes 53 in the wing plates 51 of the pivot seat 50 and the curved guide slots 45 in the pivot plates 42 of the base 40. The frictional rod 82 is movable to press against the frictional surface 811 of the frictional block 81. The frictional block 81 is made of rubber.

Referring to FIG. 7, the first pivot rod 91 extends through the pivot holes 44 in the pivot plates 42 of the base 40 and the first pivot holes 54 in the wing plates 51 of the pivot seat 50. Thus, the pivot seat 50 is rotatable relative to the base 40 about the first pivot rod 91.

The second pivot rod 92 extends through the second pivot holes 55 in the wing plates 51 of the pivot seat 50 and the pivot holes 63 in the wing plates 61 of the connecting seat 60. Thus, the connecting seat 60 is rotatable relative to the pivot seat 50 about the second pivot rod 92.

Figure 11:
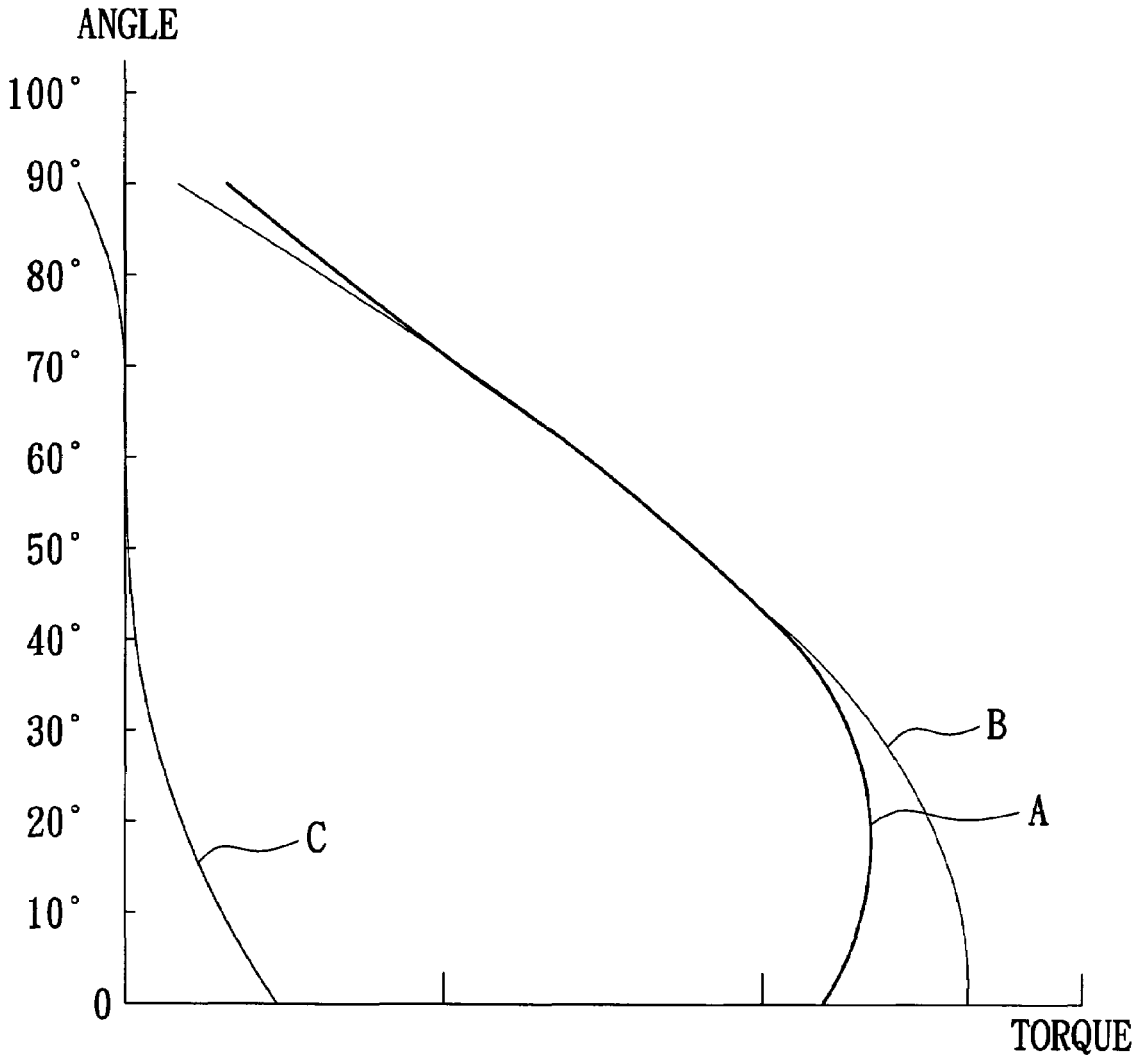
FIG. 11 is a graph showing the distribution of a spring torque, a gravitational torque and a difference therebetween as a function of an opening angle of the top cover.

Referring to FIGS. 7 and 11, the resilient member 73 applies a pull force to the second supporting rod 72. The pull force is transmitted to the connecting seat 60, the pivot seat 50 and the top cover 32, and therefore produces a counterclockwise spring torque (A) on the first pivot rod 91. The top cover 32, on the other hand, produces a clockwise gravitational torque (B) on the first pivot rod 91. Each of the spring torque (A) and the gravitational torque (B) changes according to the positions of the pivot seat 50 and the connecting seat 60. FIG. 11 shows changes in the spring torque (A), the gravitational torque (B) and the difference (C) therebetween as a function of the opening angle of the top cover 32, wherein C=B−A. The frictional rod 82 is movable to contact the frictional surface 811 so as to impart a resistance to pivoting of the pivot seat 50 and, hence, of the top cover 32. The resistance varies according to the position of the frictional rod 82 relative to the frictional surface 811 so as to cancel out the difference (C) when the difference (C) is present. As such, when the top cover 32 is released, it can be maintained at any position, as described below.

When the top cover 32 is closed (i.e., when the opening angle of the top cover 32 is zero), the gravitational torque (B) is greater than the spring torque (A). Thus, the top cover 32 is maintained at the closed position. At this time, the frictional rod 82 is disposed at the second slot end 452 of the curved guide slot 45 (and not in contact with the frictional surface 811), and the second supporting rod 72 is disposed at the first slot end 561 of the curved slide slot 56.

Referring to FIGS. 7, 8, and 11, when the top cover 32 is pivoted upwardly from the closed position, the pivot seat 50 rotates about the first pivot rod 91 in a counterclockwise direction, and the frictional rod 82 moves from the second slot end 452 of the curved guide slot 45 toward the first slot end 451 of the curved guide slot 45. Hence, the frictional rod 82 comes into frictional contact with the frictional surface 811 of the frictional block 81.

When the top cover 32 is opened to an angle smaller than approximately 50 degrees, the gravitational torque (B) is greater than the spring torque (A), as shown in FIG. 11. As a consequence, the top cover 32 tends to pivot toward the closed position. However, because the frictional force between the frictional rod 82 and the frictional surface 811 can cancel out the difference (C), when the top cover 32 is released, it remains in situ. That is, the top cover 32 is self-positioning. The greater the opening angle of the top cover 32, the smaller the distance between the first and second supporting rods 71, 72, and the smaller the spring force of the resilient member 73 to bias the top cover 32 to pivot upwardly.

When the opening angle of the top cover 32 with respect to the machine body 31 is greater than roughly 70 degrees, the gravitational torque (B) is smaller than the spring torque (A). Thus, the top cover 32 has a tendency to pivot upwardly. However, since the frictional rod 82 is in frictional contact with the frictional surface 811, friction between the frictional rod 82 and the frictional surface 811 can cancel out the difference (C). As such, the self-positioning capability of the top cover 32 can be maintained throughout movement of the top cover 32 from the closed position to the completely open position.

Referring to FIG. 9, when the top cover 32 is completely opened, the frictional rod 82 moves to the first slot end 451 of the curved guide slot 45, and the top cover 32 abuts against the base 40. Thus, the top cover 32 is positioned at an angle of roughly 90 degrees relative to the machine body 31.

Figure 10:
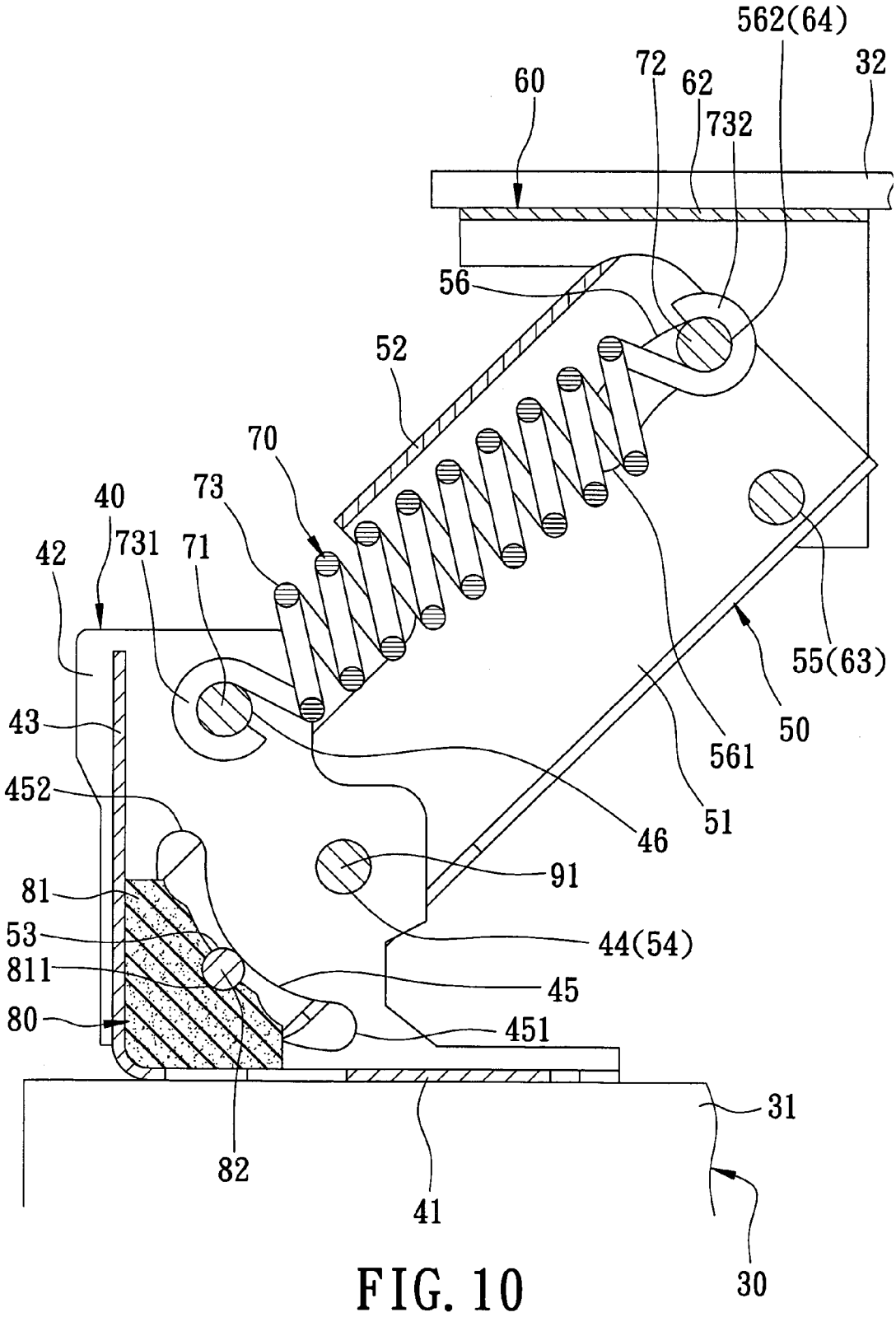
FIG. 10 is a sectional side view of the preferred embodiment, illustrating the position of the top cover of the office machine when manipulation of a thick document is required.

Referring to FIGS. 9 and 10, when a thick document is used in the office machine 30, the top cover 32 is turned downwardly from the 90° open position toward the closed position. At the same time, the connecting seat 60 rotates about the second pivot rod 92 in a clockwise direction. Thus, the second supporting rod 72 moves from the first slot end 561 of the curved slide slot 56 to the second slot end 562 of the curved slide slot 56. This increases the distance between the first and second supporting rods 71, 72 and, therefore, the spring pull force of the resilient member 73. As a result, the spring torque (A) is greater than the gravitation torque (B) so as to bias the top cover 32 to pivot upwardly toward the 90° open position. When the top cover 32 rests on the thick document (not shown), the friction between the frictional rod 82 and the frictional surface 811 can also cancel out the difference (C) so as to maintain the positioning of the top cover 32 on the thick document.

Alternatively, the top cover 32 may be mounted directly to the pivot seat 50. In this case, the connecting seat 60, the second pivot rod 92 and the curved slide slots 56 in the wing plates 51 of the pivot seat 5 are omitted from the configuration. This still allows for the self-positioning of the top cover 32.

Figure 1:
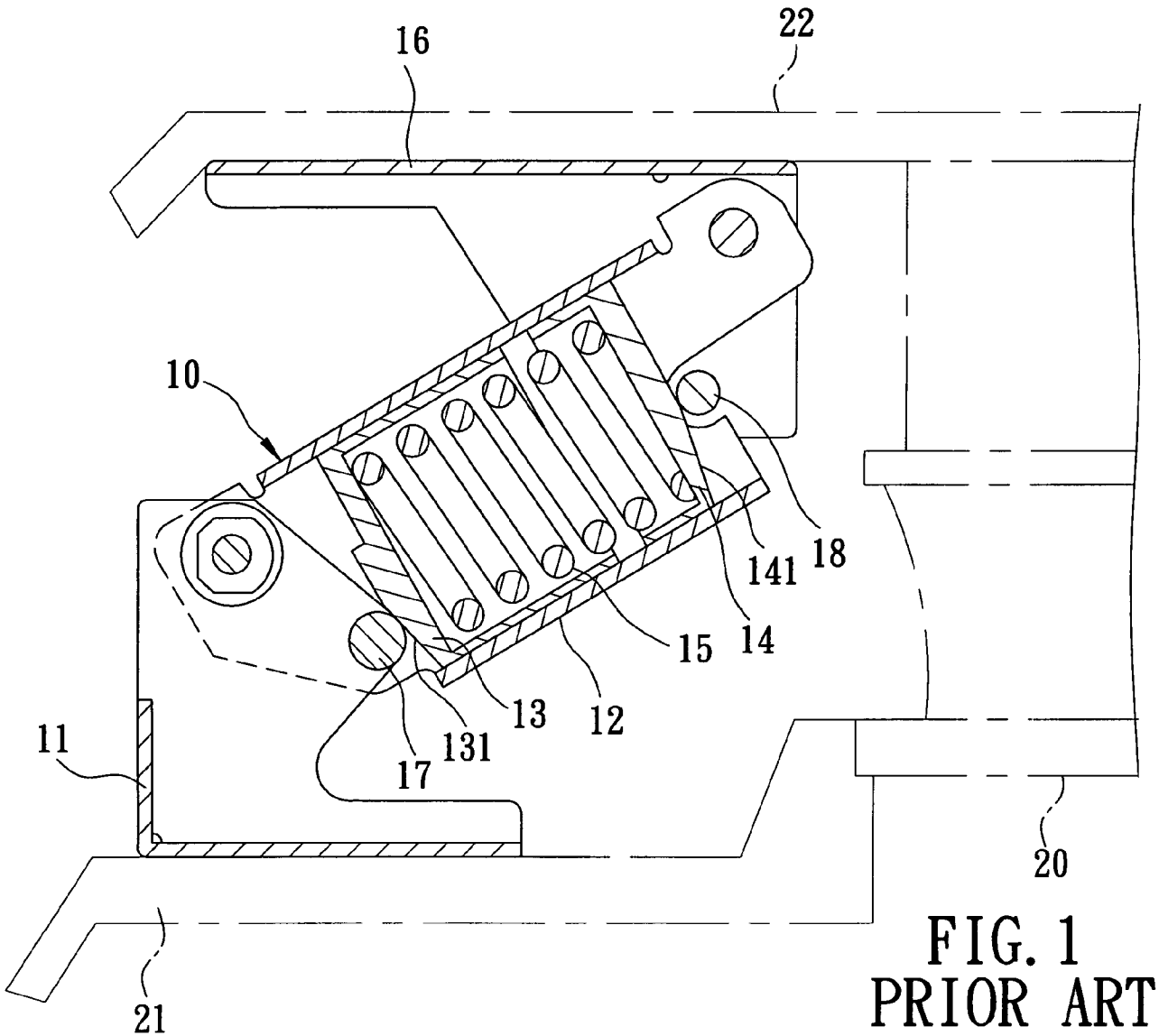
FIG. 1 PRIOR ART
FIG. 1 is a sectional side view of a conventional knuckle arm disclosed in U.S. Pat. No. 6,456,365.

The knuckle arm of this invention has the following advantages:

(1) The knuckle arm requires fewer parts than the prior art (see FIG. 1), and therefore can be made at a low cost.

(2) To enable self-positioning of the top cover 32, the frictional surface 811 is provided to cooperate with the frictional rod 82. The manufacture of the frictional surface 811 is easier than that of the cam surfaces 131, 141 (see FIG. 1) of the prior art so as to further reduce the manufacturing costs of the knuckle arm.

Therefore, the object of this invention can be achieved.

With this invention thus explained, it is apparent that numerous modifications and variations can be made without departing from the scope and spirit of this invention. It is therefore intended that this invention be limited only as indicated by the appended claims.

We claim:

1. A knuckle arm adapted to be connected to a machine body and a top cover of a machine, said knuckle arm comprising:

a base including a mounting plate adapted to be disposed fixedly on the machine body, and two pivot plates extending respectively from two opposite sides of said mounting plate, each of said pivot plates being formed with a pivot hole;

a pivot seat including two wing plates located respectively to two opposite sides of an assembly of said pivot plates of said base, and a connecting plate interconnecting said wing plates of said pivot seat and adapted to be attached to the top cover of the machine, each of said wing plates of said pivot seat being formed with a first pivot hole;

a first pivot rod extending through said pivot holes in said pivot plates of said base and said first pivot holes in said wing plates of said pivot seat so as to allow for pivoting of said pivot seat about said first pivot rod;

a biasing unit disposed between said base and said pivot seat so as to bias said pivot seat to pivot upwardly about said first pivot rod; and a friction assembly disposed between said pivot seat and said base so as to impart a resistance to pivoting of said pivot seat about said first pivot rod, thereby maintaining said pivot seat at any position, wherein each of said pivot plates of said base is formed with a curved guide slot, each of said wing plates of said pivot seat being formed with a through hole, said frictional assembly including a frictional block disposed fixedly on said base and having a frictional surface, and a frictional rod extending through said through holes in said wing plates of said pivot seat and said curved guide slots in said pivot plates of said base and movable to press against said frictional surface of said frictional block.

2. The knuckle arm as claimed in claim 1, wherein said biasing unit includes a first supporting rod extending through said pivot plates of said base, a second supporting rod extending through said wing plates of said pivot seat, and a resilient member disposed between said first and second supporting rods.

3. The knuckle arm as claimed in claim 1, wherein said base further includes a connecting plate extending integrally from said mounting plate and connected fixedly to said pivot plates.

4. A knuckle arm adapted to be connected to a machine body and a top cover of a machine, said knuckle arm comprising:

a base including a mounting plate adapted to be disposed fixedly on the machine body, and two pivot plates extending respectively from two opposite sides of said mounting plate, each of said pivot plates being formed with a pivot hole;

a pivot seat including two wing plates located respectively to two opposite sides of an assembly of said pivot plates of said base, and a connecting plate interconnecting said wing plates of said pivot seat and adapted to be attached to the top cover of the machine, each of said wing plates of said pivot seat being formed with a first pivot hole;

a first pivot rod extending through said pivot holes in said pivot plates of said base and said first pivot holes in said wing plates of said pivot seat so as to allow for pivoting of said pivot seat about said first pivot rod;

a biasing unit disposed between said base and said pivot seat so as to bias said pivot seat to pivot upwardly about said first pivot rod; and a friction assembly disposed between said pivot seat and said base so as to impart a resistance to pivoting of said pivot seat about said first pivot rod, thereby maintaining said pivot seat at any position, wherein said biasing unit includes a first supporting rod extending through said pivot plates of said base, a second supporting rod extending through said wing plates of said pivot seat, and a resilient member disposed between said first and second supporting rods, and wherein said resilient member is configured as a coiled tension spring, and has two end hooks that engage respectively said first and second supporting rods.

5. The knuckle arm as claimed in claim 4, wherein each of said pivot plates of said base is further formed with a through hole therethrough, said first supporting rod extending through said through holes in said pivot plates of said base.

6. The knuckle arm as claimed in claim 5, wherein each of said wing plates of said pivot seat is further formed with a second pivot hole and a curved slide slot, said knuckle arm further comprising:

a connecting seat including two wing plates located respectively to two opposite sides of an assembly of said wing plates of said pivot seat, and a connecting plate interconnecting fixedly said wing plates of said connecting seat and adapted to be connected fixedly to the top cover of the machine, each of said wing plates of said connecting seat being formed with a pivot hole and a through hole; and a second pivot rod extending through said second pivot holes in said wing plates of said pivot seat and said pivot holes in said wing plates of said connecting seat so as to allow for pivoting of the top cover relative to said pivot seat about said second pivot rod, said second supporting rod extending through said through holes in said wing plates of said connecting seat and said curved slide slots in said wing plates of said pivot seat.

* * * * *